United States Patent [19]

Fangeat et al.

[11] Patent Number: 4,967,548

[45] Date of Patent: Nov. 6, 1990

[54] FIRE-RESISTANT TEXTILE YARN AND USE THEREOF

[75] Inventors: Roland Fangeat, Vert Le Petit; Pierre Christ, Epinal; Alain Choserot, Golbey, all of France

[73] Assignee: Filature de la Gosse, S.A., Golbey, France

[21] Appl. No.: 159,574

[22] PCT Filed: Jun. 2, 1987

[86] PCT No.: PCT/EP87/00293

§ 371 Date: Apr. 4, 1988

§ 102(e) Date: Apr. 4, 1988

[87] PCT Pub. No.: WO87/07656

PCT Pub. Date: Dec. 17, 1987

[30] Foreign Application Priority Data

Jun. 4, 1986 [FR] France ..... 86 08024

[51] Int. Cl.[5] ..... D02G 3/02; D02G 3/12; D02G 3/18; D02G 3/38

[52] U.S. Cl. ..... 57/224; 57/210; 57/229; 428/364; 428/372; 428/379; 428/392; 428/395

[58] Field of Search ..... 57/210, 229, 224, 209; 428/395, 375, 372, 393, 392, 391

[56] References Cited

U.S. PATENT DOCUMENTS

| | | | |
|---|---|---|---|
| 4,331,729 | 5/1982 | Weber | 428/257 |
| 4,384,449 | 5/1983 | Byrnes, Sr. | 57/210 |
| 4,500,593 | 2/1985 | Weber | 428/377 |

FOREIGN PATENT DOCUMENTS

| | | | |
|---|---|---|---|
| 2018323 | 10/1979 | United Kingdom . | |
| 2096658A | 10/1982 | United Kingdom | 57/229 |

OTHER PUBLICATIONS

The Modern Textile Dictionary, George E. Linton, Ph. D. Duell, Sloan & Pearce, p. 1068.

"High-Tech Yarns" pamphlet of Fehrer AG Engineered Yarns with DREF-Friction Spinning Technology.

*Primary Examiner*—George F. Lesmes
*Assistant Examiner*—Jill M. Gray
*Attorney, Agent, or Firm*—Cushman, Darby & Cushman

[57] ABSTRACT

Yarn comprising a core consisting of an inorganic filament surrounded by fibers made at least partly from aramide resin. The yarn count is between 30 and 60 tex, the weight proportion of the core is between 10 and 25%, the aramide fibers being spun around this core free from axial torsion.

5 Claims, No Drawings

FIRE-RESISTANT TEXTILE YARN AND USE THEREOF

The present invention relates to a fire-resistant textile yarn, comprising an inorganic filament core surrounded by fibres formed at least in part from aramid resin, and relates further to use of this yarn.

It has already been proposed to use these aramid fibres to produce yarn for making a fire-resistant material. The said aramid fibres are similar in appearance to polyamide 6—6 fibres and are resistant to bending and equivalent abrasion. However, while polyamide 6—6 melts at 250° C., aramid fibres at this temperature have a resistance to rupture equivalent to 60% of their resistance at room temperature. Aramid fibres do not melt, but begin to deteriorate above 370° C.

U.S. Pat. No. 4,381,639 discloses a yarn of the type comprising a core, formed from a continuous filament comprising at least 96% $SiO_2$, surrounded by aramid fibres, the mass ratio of fibres/core being 40:60 with a core 0.5 mm in diameter. Yarn of this type is unsuitable for making clothing fabric, but can only be used for producing protective fabric for items of safety clothing which are only to be worn for performing special tasks, for a limited period. The mass ratio of aramid fibres and the core is too low to ensure proper covering of the core. As the aramid fibres are pigmented and the filament of the core is not, this core will appear in the fabric. Although poor covering of the core is acceptable for safety clothing for professional use only, this is not the case when the fabric is intended for clothing which, in addition to its fire-resistant properties, is also to comprise an item of clothing, the appearance and comfort of which should be comparable to those of ordinary fabric. This is especially the case with fabrics used in making uniforms.

It is obvious that if, in the case of the type of yarn disclosed in the aforementioned document, it were desirable to increase substantially the mass ratio of aramid fibres relative to that of the core, the yarn count would at the same time be increased and would therefore become too high for making clothing fabric.

The thickness of the filament used to form the core of the yarn is in particular imposed by the twisting which this filament undergoes during the operation to spin the aramid fibres around the core, twisting which a substantially finer filament would not tolerate or which would excessively weaken it.

It has likewise been proposed in U.S. Pat. No. 4,384,449 to manufacture a yarn with a core made from an inorganic substance around which two aramid filaments or yarns formed from aramid fibres are wound along two counter-directional helixes. Where the core is surrounded by aramid fibres the yarns are spun beforehand, so that the resulting yarn is a type of twister yarn formed about a core. The aramid fibres are therefore not spun around a frame. It is obvious that a yarn of this type can be used to produce a protective fabric, particularly for making gloves, but would not be suitable for making clothing fabric.

It will be seen that the heat-resistant yarns proposed by the prior art can be used to manufacture protective fabrics, but would not be used to make fabrics suitable for clothing. Fabrics of this type should have, in addition to their properties for protecting against heat and fire, the appearance of any other clothing fabric and adequate mechanical resistance to stress and rupture.

This fabric must obviously be permeable to air and vapour to allow physiological exchanges to occur, and its surface unit weight should not be too great, but should be comparable to that of normal clothing fabric.

The aim of the present invention is to propose a solution combining these different requirements.

To this end, the subject of the invention is a heat-resistant textile yarn comprising an inorganic filament core surrounded by fibres formed at least in part from aramid resin, characterised in that the yarn count is between 30–50 tex, the mass ratio of the core being between 10% and 25%, the aramid fibres being spun around this core without axial twisting. The subject of this invention is also the use of this yarn in making clothing fabric, characterised in that the warp yarn count is 10% to 20% lower than the weft yarn count, the inorganic filament of the wrap yarn making up 10% to 15% of the mass of the yarn count, while the inorganic filament of the weft yarn accounts for 20% to 25% of the yarn count.

In contrast to yarns with a glass core surrounded by aramid fibres or a mixture comprising at least a proportion of these fibres, spun with axial twisting of the core, for example using the open end spinning process, the yarn which is the subject of the invention is provided with a core which is not axially twisted, which means that the proportion of core can be reduced substantially. This means that a much finer yarn can be produced in which the core has a better covering of fibres, and means that a much more flexible yarn can be produced. The finer the core, the more flexible the yarn and the easier it is to conceal it with a layer of fibres. In a fire-resistant fabric formed by a conventional yarn with a glass core, it is difficult to conceal the core completely, without making a thick yarn, the core already being relatively thick on its own. Although fabric of this type is acceptable for making work clothing, it is not so for making a uniform for example, for which the appearance should obviously not be in any way different from that of traditional fabric, even though special properties are required.

The manufacture of the yarn, which is the subject of the invention, with a fine non-axially twisted core, more particularly with a monofilament is achieved by what is known as the DREF process, performed by a spinning frame made by the FEHRER company. According to this process, the fibres are wound around the core. Since the core is not subjected to axial twisting as in the conventional spinning process, it is therefore possible to use a glass monofilament which, for a yarn of 30 to 50 tex, makes up between 10% and 25% by weight of this yarn, i.e. a filament of between approximately 50 and 80 μm.

Two different yarns have been manufactured using this principle. The first is a yarn of 50 tex comprising a glass monofilament of 11 tex having a diameter of approximately 75 μm surrounded by 50% Kermel® aramid fibres made by Rhône-Poulenc and 50% viscose fibres spun on a DREF 3 machine. The strength of this yarn is 10N, its coefficient of variation a % of the strength CV%R is 3.5 and its % extension is 3%.

The second of these yarns has a count of 42 tex and comprises a glass monofilament of 5.5 tex having a diameter of approximately 50 μm surrounded by fibres comprising 50% Kermel® aramid fibres made by Rhône-Poulenc and 50% viscose fibres spun on a DREF 3 machine. The strength of this yarn is 6N, its coefficient of variation as a % of the strength CV%R is 3.5 and its regain is 3%.

These two yarns were used for manufacturing a herringbone twill fabric from Kermel ® viscose 220 with a glass core. The thicker yarn of 50 tex with a glass core of 11 tex is used as the weft yarn and appears on the reverse side of the fabric, while the finer of 42 tex with a glass core of 5.5 tex is used as the warp yarn and thus comprises the visible part of the fabric. As a result of this combination, the thicker weft yarn, provided with a core having a diameter 50% greater than that of the warp yarn improves the strength of the fabric. However, even if the covering of the glass core of the weft yarn is not complete, with the herringbone twill this yarn only appears on the reverse side of the fabric. Contrastingly, the finer core of the warp yarn, where it provides the yarn with lower strength, allows better covering of the glass core and appears on the visible side of the fabric.

The fabric manufactured in this way underwent a number of tests carried out by the Institut Textile de France. These tests were performed in accordance with the AFNOR (French Standards Institute) standards in a normal atmosphere with relative humidity of 65% and at a temperature of 20° C. The mass of the fabric per $m^2$ according to French standard NF G 07104 was 225 g and permeability to air in accordance with AFNOR G 07111 was tested on a TEXTEST permeability meter. The value is expressed in liters of air passing through 1 $m^2$ of fabric per second ($1/m^2/s$) with a depression of 20 mm of water. This permeability was 458 (402–528).

The table below gives the mechanical properties of the fabric measured in the direction of the warp and the weft. The rupture force and the extension at rupture are measured in accordance with French standard NF 07119 on samples of 20×5 cm using an INSTRON 1175 electronic dynamometer with a constant extension gradient. The induced rupture is measured in accordance with AFNOR G 07148 using a Lhomargy rupturemeter (high capacity active force pendulum ram impact testing machine). The behaviour during repeated folding was tested in order to determine the loss in rupture strength after being folded 10,000 times using an ITF Lyon flexometer with rollers on which the sample is folded alternately in the forward direction and the reverse direction. The dynamometric measurement was taken in order to determine the loss in rupture strength after being folded 10,000 times.

TABLE 1

| | Warp | Weft |
|---|---|---|
| Rupture force daN | 73.2 (71.4–74.4) | 86.6 (80.6–90.8) |
| % Extension at rupture | 13.5 (13.1–13.9) | 6.9 (6.6–7.5) |
| Induced rupture daN | 3.6 (3.3–3.7) | 4.6 (4.3–5.0) |
| Behaviour during repeated folding | | |
| Normal fabric strength daN | 73 (71.9–74.7) | 83.4 (78.9–89.4) |
| after 10,000 folds daN | 73.8 (71.9–75.6) | 77.2 (74.5–79.3) |
| Loss in strength | 0% | 7.4% |

This fabric also underwent inflammability tests in accordance with AFNOR standard G 07113. The table below gives the values measured using six samples, three warp and three weft:

TABLE 2

| Warp Samples | Area of the charred region $cm^2$ | Weft samples | Area of the charrad region $cm^2$ |
|---|---|---|---|
| 1 | 14 | 4 | 10 |
| 2 | 13 | 5 | 11 |
| 3 | 11 | 6 | 16 |
| Average | 13 | Average | 12 |
| | | Overall averge: 12.5 | |

The same fabric underwent water-proofing and oil-proofing treatment using two products: a water-proofing product by Ciba-Geigy sold under the trade name of Phobotex ® FTC which is a derivative of the condensation of formaldyehyde and an amino 1.3.5 triazine with 1 or 2 $NH_2$ groups and an oil-proofing agent by the 3M company marketed in France by Ciba-Geigy under the trade name Scotchgard ® FC 232.

The Kermel viscose 220 herringbone twill fabric with the glass core treated in this way underwent surface wetting comparison tests in accordance with the standard NF G 07056, water penetration tests according to standard NF G 07057 and oil penetration tests according to the Scotchgard AATCC 118 method. To carry out this comparison a Kermel/Viscose 205 herringbone twill fabric was used.

The tests were performed on two samples of fabric after treatment, and on samples which had been dry cleaned in the presence of perchlorethylene without RB 1/10 booster for 20 mins and dried at room temperature.

The table below gives the results measured after the various tests. The table comprises three columns ST, SCHMERBER and OLEO referring respectively to surface wetting by spray, penetration by water and the Scotchgard method developed by the 3M company and accepted as a universal reference, each of these three columns is subdivided into two columns EO and 1N indicating respectively the measurement taken from the fabric before cleaning and from the fabric after dry cleaning in the aforementioned conditions. For the ST and OLEO tests the figures correspond to performance indices 1 to 5, the last figure indicating the best performance. With regard to the SCHMERBER test the figures indicate the height of the water column in mm to obtain fabric penetration.

TABLE 3

| | ST | | SCHMERBER | | OLEO | |
|---|---|---|---|---|---|---|
| | EO | 1N | EO | 1N | EO | 1N |
| Grey/green KV 205 | 5 | 2 | 180–190 | 160–170 | 5 | 2 |
| Glass core KV 220 | 5 | 2 | 130–140 | 150–150 | 5 | 2 |

Where it is desirable for the fabric to be able to undergo thermal treatment in order, in particular, to remove harmful chemical products with which it has been impregnated, it may be advantageous to replace the glass core with a metal core in order to provide the possibility of heating by inducing an electric current in the metal core. In the case of steel for example with a 50 tex yarn, the maximum diameter of the filament would be limited to 45 μm for a proportion by weight of 25%.

On the other hand, it would be possible to form filaments of B or SiC on a core of W 13 μm in diameter on which boron is deposited by the chemical decomposition of $BCl_3$. The same process can be used to produce filaments of W/SiC. This information is contained in the "Encyclopaedia of Chemical Technology" Kirk-Othmer, Third edition, Volume 6 page 296 (John Wiley and Sons). Given the low density of the boron or the SiC it is possible to make filaments which are stronger than steel for an equivalent cross section. In that case, and so as not to exceed the proportion of 25% for yarns of 50 tex, the W/B filaments may have a maximum diameter of 75 μm and those of W/SiC 65 μm allowing for the tungsten core of 13 μm. Naturally, filaments of this type allow the proportion by weight of the core to be reduced relative to this maximum value whilst providing the fabric with good mechanical strength, the filaments being able to be made to the required diameter by accretion about the initial tungsten core of 13 μm.

We claim:

1. A fire-resistant textile yarn comprising an inorganic filament core surrounded by fibres formed from at least 50% by weight of aramid resin, wherein the yarn count is between 30–50 tex, the mass ratio of the core being between 10% and 25%, the aramid fibres being spun without axial twisting around this core.

2. A textile yarn according to claim 1, comprising 50% aramid fibres and 50% viscose fibres.

3. A textile yarn according to claim 1, wherein the core is a monofilament.

4. A textile yarn according to claim 3, wherein the core is a glass filament.

5. A textile yarn according to claim 3, wherein the core is a metal filament.

* * * * *